US005848599A

United States Patent [19]

Todd

[11] Patent Number: 5,848,599

[45] Date of Patent: Dec. 15, 1998

[54] APPARATUS FOR CRIMPING AND TATTOOING HAIR

[76] Inventor: Mark D. Todd, 1815 Lake Rd., Webster, N.Y. 14580

[21] Appl. No.: 901,815

[22] Filed: Jul. 28, 1997

[51] Int. Cl.[6] ..... A45D 1/06

[52] U.S. Cl. ..... 132/221; 132/224

[58] Field of Search ..... 132/206, 207, 132/208, 221, 223, 224, 225, 319; 606/116

[56] References Cited

U.S. PATENT DOCUMENTS

| | | | |
|---|---|---|---|
| D. 315,968 | 4/1991 | Rizzuto et al. | D28/35 |
| 1,709,981 | 4/1929 | Headington | 132/225 |
| 2,274,170 | 2/1942 | Stanley | 132/221 |
| 2,705,499 | 4/1955 | Breeze | 132/207 |
| 3,433,232 | 3/1969 | Garrett | 132/208 |
| 4,739,151 | 4/1988 | Smal | 132/225 |
| 5,470,351 | 11/1995 | Ross et al. | 132/319 |

FOREIGN PATENT DOCUMENTS

| | | | |
|---|---|---|---|
| 341869 | 1/1931 | United Kingdom | 132/224 |

*Primary Examiner*—Todd E. Manahan

*Attorney, Agent, or Firm*—Jaeckle Fleischmann & Mugel, LLP

[57] ABSTRACT

An assembly for crimping and tattooing hair comprises a film with hair coloring material disposed thereon and a hair crimping device with a first jaw and a second jaw. A female die member is attached to the first jaw and a male die member is attached to the second jaw. The female die member has a first die plate which contains a channel extending around a substantially solid die member. The channel has a depth of from about 0.032 inches to about 0.124 inches. The male die plate has a protruding portion extending around a substantially hallow die member and has a shape corresponding to the shape of the channel in the female die member. The protrusion has a height of from about 0.016 inched to about 0.093 inches. The die plates further include at least two chamfered edges.

10 Claims, 4 Drawing Sheets

APPARATUS FOR CRIMPING AND TATTOOING HAIR

FIELD OF THE INVENTION

An apparatus for crimping and tattooing hair.

BACKGROUND OF THE INVENTION

Design U.S. Pat. No. 315,968 of Leandro P. Rizzuto et al. discloses a hair crimping head appliance comprising a male portion and a female portion. The male portion of the device depicted comprises a protruding heart-shaped die; the female portion of the device comprises a heart-shaped recess which extends through the entire thickness of the female die plate.

However, the device of the Rizzuto et al. patent is not adapted to produce a sharply-defined colored crimped impression in a user's hair. It is an object of this invention to provide a device which is adapted to produce such colored, sharply-defined, crimped, hair impression.

SUMMARY OF THE INVENTION

In accordance with this invention, there is provided a kit for producing sharply defined, crimped, colored impressions in hair. This kit comprises a heat-resistant film material containing a hair color on at least one of its sides, and a hair crimping iron which contains a male die plate and a female die plate, each with specified characteristics.

BRIEF DESCRIPTION OF THE DRAWINGS

The invention will be illustrated by reference to the specification and the following drawings, in which like numerals refer to like elements, and in which.

DESCRIPTION OF THE PREFERRED EMBODIMENTS

Figure 1:
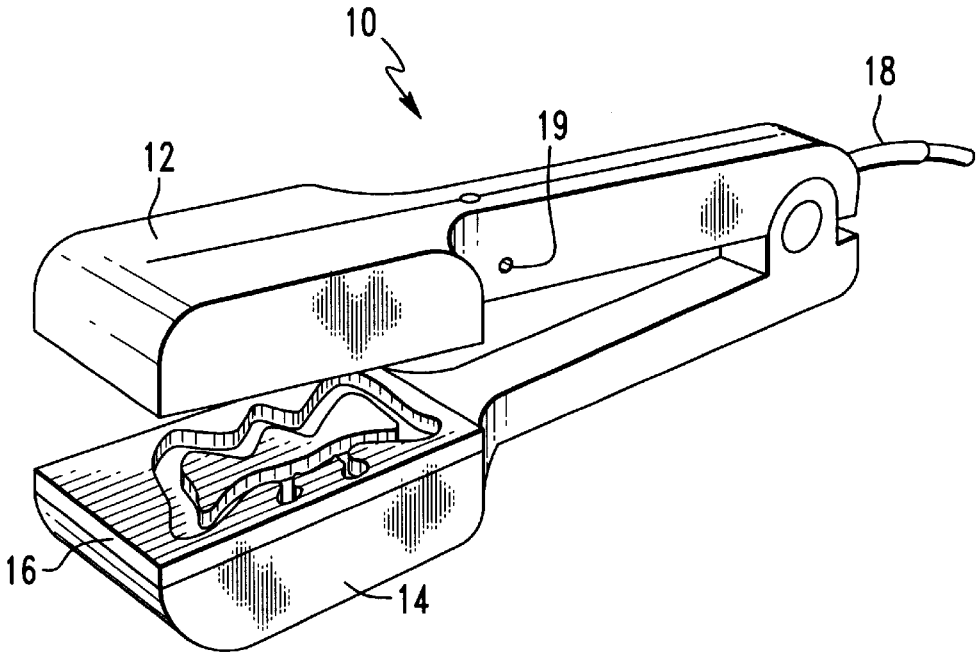
FIG. 1 is a perspective view of one preferred crimping iron of this invention.

FIG. 1 is a perspective view of one preferred thermal crimper 10 of this invention. Referring to FIG. 1, it will be seen that thermal crimper 10 is comprised of a top jaw 12 hingably attached to a bottom jaw 14. A female die 16 is connected to the bottom jaw 14 and is adapted to engage a male die (not shown in FIG. 1) connected to top jaw 12. Electrical means (not shown) connected to a source of electricity 18 preferably heat the male and female dies during the operation of thermal crimper 10.

One may use any of the thermal crimping devices disclosed in the prior art. Thus, by way of illustration and not limitation, one may the one or more of the devices disclosed in U.S. Pat. Nos. 5,025,850, D316,762, D315,968, D315,967, D309,354, and the like. The disclosure of each of these United States patents is hereby incorporated by reference into this specification.

In one embodiment, the thermal crimper 10 is similar to the thermal crimper disclosed in U.S. Pat. No. 4,917,078 of Zaborowski, the entire disclosure of which is hereby incorporated by reference into this specification. The thermal crimper of this patent is a heatable hairstyling device which comprises: (a) a hand-grippable body section having a proximal end and a distal end; (b) a stationary hairstyling jaw member secured to said distal end of said body section and having an interiorly directed heatable plate surface, and (c) a movable hairstyling jaw member pivotally secured to said distal end of said body section having an interiorly directed member.

By way of further illustration, one may use the hair crimper disclosed in U.S. Pat. No. 4,870,250 of Rizzuto, the entire disclosure of which is hereby incorporated by reference into this specification. This Rizzuto patent discloses a device that includes a handle and pivoted upper and lower clamp halves thereon and electrical connections therein.

By way of yet further illustration, one may use the crimping iron sold by the Belson Products Company of Miami Lakes, Fla. as "GOLD'N HOT". This device may be utilized by removing the "goldtone crimping plates" which come with it and substituting applicant's novel male and female die plates.

Referring again to FIG. 1, and in the preferred embodiment depicted therein, it will be seen that the crimping device 10 depicted therein has been modified so that a hole 19 appears therein. This orifice 19 may be used to introduce hair dye (not shown) into the interior of the crimping device 10 so that it may contact the channels within the male and female dies.

Figure 2:
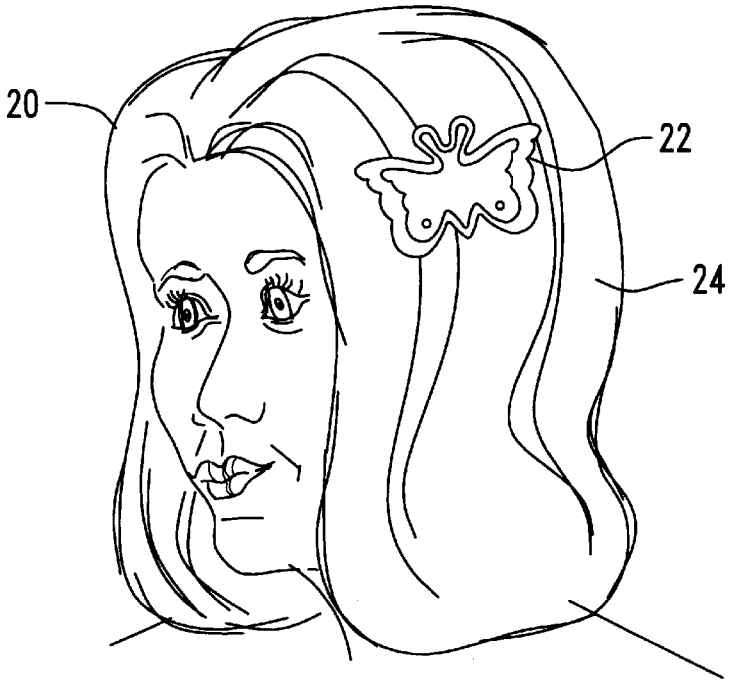
FIG. 2 is a perspective view of the crimped impression produced by the crimping iron of FIG. 1.

FIG. 2 is a perspective view of a user 20 with a thermally crimped and colored impression 22 in her hair 24.

Figure 3:
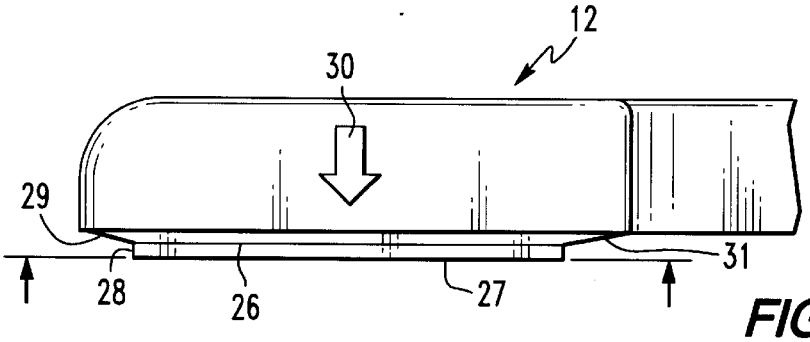
FIG. 3 is a partial side view of the top jaw of the crimping iron of FIG. 1.

FIG. 3 is a partial side view of jaw 12. Referring to FIG. 3, it will be seen that jaw 12 is connected to male die plate backing 26 integrally connected to die plate 28. In the embodiment depicted in FIG. 3, jaw 12 is moving in the direction of arrow 30. However, as will be apparent to those skilled in the art, when jaws 12 and 14 are hingeably attached to each other (see FIG. 1), arrows 30 and 32 will not necessarily be linear and parallel at all portions of the jaw travel. As will be apparent to those skilled in the art, however, the jaws 12 and 14 ultimately compress hair 24 between them (see FIG. 11).

Referring again to FIG. 3, it is preferred that male die plate backing 26 and die plate 28 consist essentially of a heat conductive metal such as, e.g., copper. The die plate assembly, in the embodiment depicted, contains chamfered edges 29 and 31.

Figure 4:
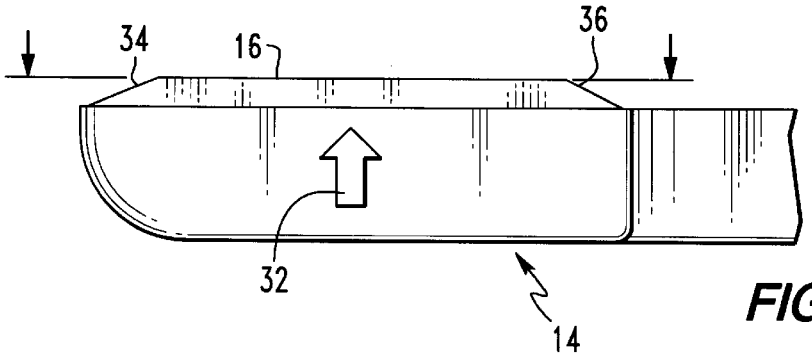
FIG. 4 is a partial side view of the bottom jaw of the crimping iron of FIG. 1.

FIG. 4 is a side view of a preferred lower jaw 14 which may be used in heat crimper 10. Referring to FIG. 10, and in the preferred embodiment depicted, it will be seen that female die plate 16 has at least two chamfered surfaces, surfaces 34 and 36. In one embodiment, not shown in FIG. 4, each of the surfaces of female die plate 16 has a chamfered edge.

Figure 5:
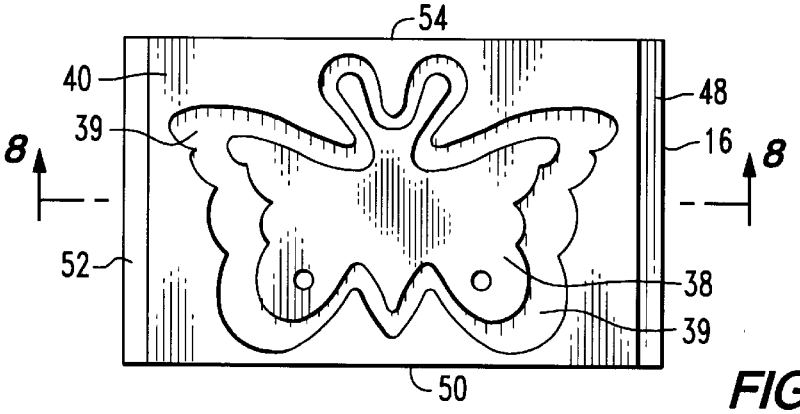
FIG. 5 is a top view of the female die plate of the crimping iron of FIG. 1.

FIG. 5 is a top view of female die plate 16, which is comprised of an upwardly extending die 38. Upwardly extending die 38, which is in the shape of a butterfly in the embodiment depicted in FIG. 5, extends above backing plate 40. This feature is shown in more detail in FIG. 8.

Figure 7:
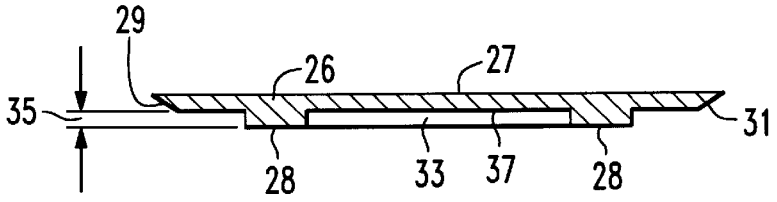
FIG. 7 is a schematic view illustrating how a user's hair is engaged by the male die plate of FIG. 6.

Referring to FIG. 7, it will be seen that protruding male 28 has a height 35 of from about 0.016 to about 0.093 inches, extending above the base 37 of recessed image 33.

Figure 8:
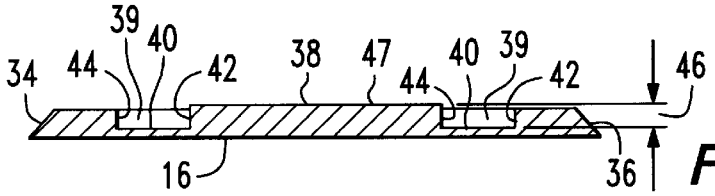
FIG. 8 is a schematic view illustrating how a user's hair is engaged by the female die plate of FIG. 5.

Referring to FIG. 8, it will be seen that upwardly extending die 38 is surrounded by a channel 39 defined by walls 40, 42, and 44. As will be apparent to those skilled in the art, a user's hair 24 (not shown in FIG. 8, but see FIGS. 1 and 2) will be compressed within channel 39 when jaws 12 and 14 are moved together.

Referring again to FIG. 8, the distance 46 by which the top wall 47 of die 38 extends above backing plate 40 is from about 0.032 to about 0.125 inches. In one embodiment, not shown, the height of the die 38 is less than the maximum height of the chamber 34 or 36.

Figure 12:
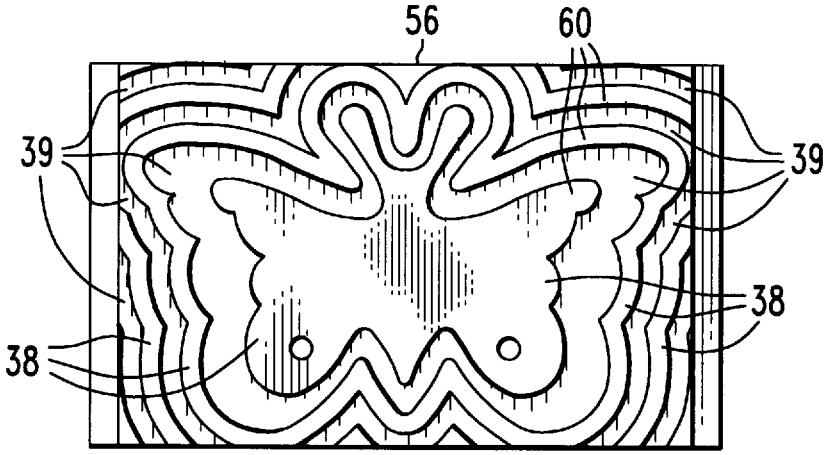
FIG. 12 is a top view of one female die plate of this invention.
Figure 13:
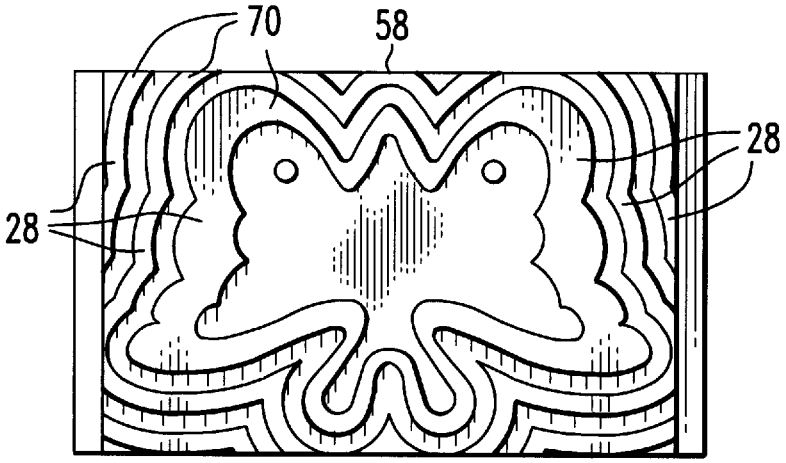
FIG. 13 is a top view of one male die plate of this invention.

Referring again to FIG. 5, and in the preferred embodiment depicted therein, each of walls 48, 50, 52, and 54 is chamfered. FIGS. 12 and 13 show similar chamfered structures for a female die member 56 and a male die member 58. As will be apparent to those skilled in the art, these die members are comprised of a series of substantially concentric areas 60 and 62 of continually decreasing height which form the chamfers.

In the embodiment depicted in FIG. 8, both the male die member 58 and the female die member 56 have two or more chamfered edges. In another embodiment, only the male member has such chamfered edges. In yet another embodiment, only the female member has such chamfered edges.

Figure 6:
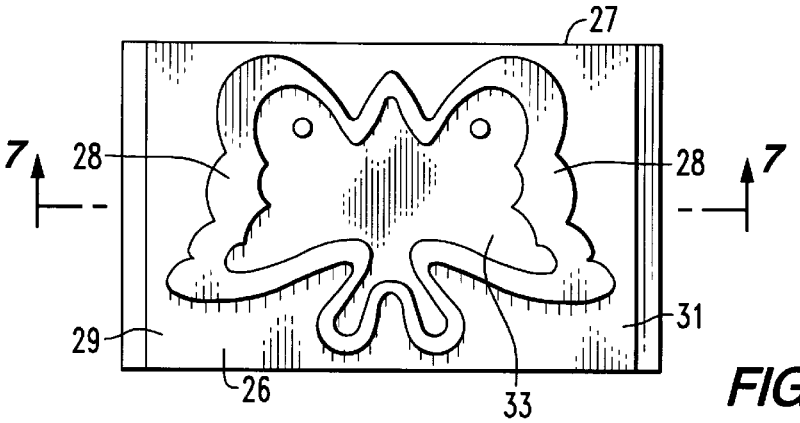
FIG. 6 is a top view of the male die plate of the crimping iron of FIG. 1.

Referring again to FIG. 6, and in the preferred embodiment depicted therein, it will be seen the die plate assembly 27, unlike the female die plate assembly 16, has an upwardly protruding die plate backing 26 which defines the perimeter of a recess image 33 with a complementary buttterfly shape as female die 38.

Figure 9:
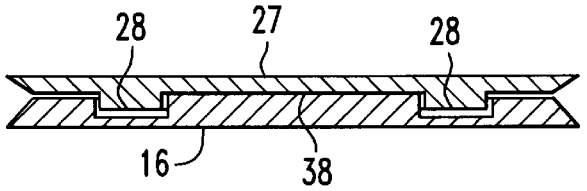
FIG. 9 is a schematic view illustrating how a user's hair is engaged when the male and female die plates are engaged with each other.

FIG. 7 is partial sectional view of male die plate assembly 27. FIG. 8 is partial sectional view of female die plate assembly 16. FIG. 9 illustrates how the two member 33 and 16 are disposed vis-a-vis each other when they are in contact.

Figure 10A:
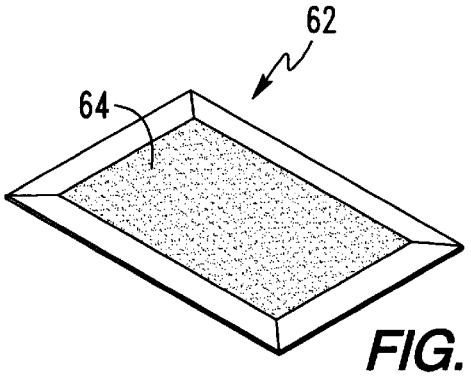
FIGS. 10A and 10B are top views of two different thermal transfer films used in the device of FIG. 1.

FIG. 10A is a perspective view of a film 62 comprised of transferable hair color material 64. One may use any of the hair coloring chemicals or compositions known to those skilled in the art. Thus, by way of illustration and not limitation, one may use one or more of the hair colorings disclosed in U.S. Pat. Nos. 5,365,438, 5,273,739, 5,196,029, 4,834,767, 4,775,527, 4,211,247, and the like. The disclosure of each of these United States patents is hereby incorporated by reference into this specification.

In one embodiment, hair color material 64 may be "GLITTER GEL," which is a washable, water-based hair color sold by Jerome Russell Cosmetics of Chatsworth, Calif. In another embodiment, hair color material 64 may be one or more of the "STAR GAZER" "semi permanent conditioning hair colors" sold by Stargazer Products of London, England. Other suitable commercially available hair colors will be readily apparent to those skilled in the art.

Referring again to FIG. 10A, film 62 may be any suitable material from which color 64 is transferable by either pressure and or heat. By way of illustration and not limitation, film 62 may be made from parchment paper, other heat-resistant paper, etc.

In the embodiment illustrated in FIG. 10A, the entire top surface of film 62 consists of only one color material 64. In another embodiment, not shown, two or more of such coloring materials are used.

Figure 10B:
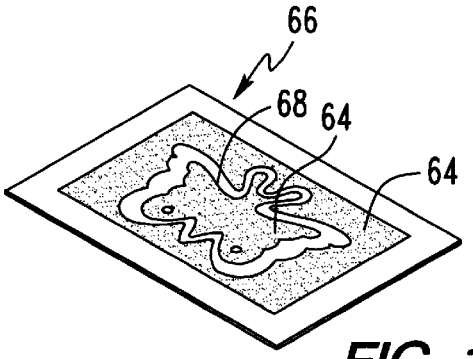

In the embodiment depicted in FIG. 10B, film 66 an outline of a butterfly 68 has been impressed within film 66, and color 64 is disposed in selected areas within the impression. The use of this film 66 will selectively transfer coloring agent to portions of the hair being treated.

It will be apparent to those skilled in the art that many different coloring agents, and/or many different combinations of coloring agents, may be disposed on all or selected portions of the films 62 or 66.

Figure 11:
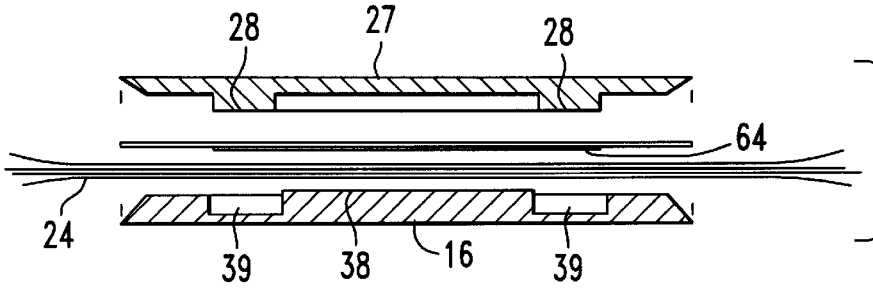
FIG. 11 is a schematic representation illustrating the interaction of the male die plate, the female die plate, the thermal transfer paper, and the hair to be treated.

FIG. 11 is a schematic representation of the use of applicant's device. As will be apparent, the hair 24 to be treated will be compressed within channels 39, and be contacted with coloring agent 64, while be shaped by protruding dies 38 and 28. The resulting treated hair will not only be selectively colored, but it also will be shaped by the dies.

It is to be understood that the foregoing description is illustrative only and that changes can be made in the structures described without departing from the scope of the invention defined by the following claims.

I claim:

1. An assembly for crimping and tattooing hair comprised of a film with a top surface and a bottom surface, and a hair crimping device comprising a first jaw and a second jaw connected to each other, wherein:

(a) at least one hair coloring material is coated onto at least one of said top surface and said bottom surface of said film, (b) attached to said first jaw is a female die member comprising a first die plate which contains a channel extending around a substantially solid die member, wherein said channel has a depth of from about 0.032 to about 0.124 inches, (c) attached to said second jaw is a male die member comprising a second die plate which contains a protruding portion extending around a substantially hollow die member, wherein said protruding portion has a height of from about 0.016 to about 0.093 inches, (d) at least one of said first die plate and said second die plate is comprised of a least two chamfered edges.

2. The assembly as recited in claim 1, wherein each of said first die plate and said second die plate consists essentially of conductive metal.

3. The assembly as recited in claim 2, wherein said assembly is comprised of means for heating said first die plate and said second die plate.

4. The assembly as recited in claim 3, wherein said first jaw and said second jaw are hingeably attached to each other.

5. The assembly as recited in claim 4, wherein said channel extending around said substantially solid die member is a continuous channel.

6. The assembly as recited in claim 5, wherein said hair coloring material is a washable hair coloring material.

7. The assembly are recited in claim 6, wherein said hair coloring material is a water-based material.

8. The assembly as recited in claim 5, wherein said film consists essentially of paper.

9. The assembly as recited in claim 8, wherein said paper is parchment paper.

10. The assembly as recited in claim 1, wherein said hair crimping device comprises a hand-grippable body section.

* * * * *